US012127611B2

(12) United States Patent
Tseng et al.

(10) Patent No.: US 12,127,611 B2
(45) Date of Patent: Oct. 29, 2024

(54) POLYMERIC GLOVES AND METHOD OF MANUFACTURE

(71) Applicant: Inteplast Group Corporation, Livingston, NJ (US)

(72) Inventors: Pai-Mei Tseng, Somerset, NJ (US); Jyh-Yao Raphael Li, Parsippany, NJ (US)

(73) Assignee: INTEPLAST GROUP CORPORATION, Livingston, NJ (US)

( * ) Notice: Subject to any disclaimer, the term of this patent is extended or adjusted under 35 U.S.C. 154(b) by 41 days.

(21) Appl. No.: 17/824,462

(22) Filed: May 25, 2022

(65) Prior Publication Data

US 2023/0380528 A1 Nov. 30, 2023

(51) Int. Cl.

| | |
|---|---|
| ***A41D 19/00*** | (2006.01) |
| ***A41H 43/02*** | (2006.01) |
| *A41D 19/02* | (2006.01) |

(52) U.S. Cl.
CPC ..... *A41D 19/0006* (2013.01); *A41H 43/0207* (2013.01)

(58) Field of Classification Search
CPC ..... A41D 19/0006; A41H 43/0207
See application file for complete search history.

(56) References Cited

U.S. PATENT DOCUMENTS 820,639 A * 5/1906 Gabrielson ..... B23Q 9/0028 30/481
925,335 A * 6/1909 Gruis ..... B25G 3/02 403/243
3,441,198 A * 4/1969 Ericson ..... B65D 31/00 383/907
3,681,784 A * 8/1972 Lindley ..... A41D 19/0068 2/167
3,866,245 A * 2/1975 Sutherland ..... A41D 19/0068 156/515
3,920,500 A * 11/1975 Brieske ..... A63H 3/08 156/289
4,034,853 A * 7/1977 Smith ..... B65D 69/00 206/390
4,346,834 A * 8/1982 Mazumdar ..... B65D 31/00 525/240

(Continued)

OTHER PUBLICATIONS

Coextrusion. (n.d.) McGraw-Hill Dictionary of Scientific & Technical Terms, 6E. (2003). Retrieved Nov. 29, 2023 from https://encyclopedia2.thefreedictionary.com/coextrusion (Year: 2003).*

(Continued)

*Primary Examiner* — Robert H Muromoto, Jr.
(74) *Attorney, Agent, or Firm* — Stinson LLP

(57) ABSTRACT

A method of making a multilayer disposable glove from individual layers of film. The method includes providing at least three individual layers of film and arranging the at least three individual layers of film into a stack. The stack includes a first stack portion that has at least two of the individual layers and a second stack portion that has at least one of the individual layers. The method also includes sealing the first and second portions together along a hand-shaped outline. The method also includes cutting the sealed stack along the hand-shaped outline so the seal remains intact, thereby forming the multilayer glove.

31 Claims, 10 Drawing Sheets

(56) References Cited

U.S. PATENT DOCUMENTS 4,476,588 A * 10/1984 Long ..... B29D 99/0067 2/167
4,820,558 A * 4/1989 Sundberg ..... A47L 13/18 383/7
5,016,286 A * 5/1991 Henriksen ..... A41D 19/0055 2/163
5,911,665 A * 6/1999 Heydarpour ..... B32B 27/08 426/127
6,790,655 B2 * 9/2004 Lyman ..... C12M 23/10 215/253
7,824,462 B2 * 11/2010 Webster ..... C22C 1/045 419/66
8,092,008 B2 * 1/2012 Goldschmiedt ..... B29C 66/1122 351/122
8,807,402 B2 * 8/2014 Backhaus ..... A41D 19/0072 223/111
9,084,445 B2 * 7/2015 Lin ..... A41D 19/00
9,131,737 B2 * 9/2015 Lin ..... A41D 19/01558
9,150,004 B2 * 10/2015 Dou ..... B32B 27/32
9,238,324 B2 * 1/2016 Dou ..... B32B 27/302
9,283,712 B2 * 3/2016 Goldschmiedt ..... B32B 27/40
9,314,999 B2 * 4/2016 Cloutier ..... C23C 14/24
9,492,962 B2 * 11/2016 Dou ..... B29C 48/08
9,635,892 B2 * 5/2017 Lin ..... B32B 7/022
10,820,639 B2 11/2020 Hull et al.
10,857,766 B2 * 12/2020 Xia ..... B32B 27/30
10,925,335 B2 2/2021 Modha et al.
11,213,081 B2 * 1/2022 Sperry ..... A41D 19/0058
11,589,627 B2 * 2/2023 Sorrels ..... B29C 65/18
2002/0094444 A1 * 7/2002 Nakata ..... G11B 5/7023 525/437
2002/0184695 A1 * 12/2002 Fowler ..... A41D 13/084 2/159
2003/0150041 A1 * 8/2003 Patel ..... A41D 19/015 2/16
2010/0265454 A1 * 10/2010 Goldschmiedt ..... B29C 65/18 351/122
2013/0067635 A1 * 3/2013 Lin ..... A41D 19/00 2/167
2013/0067637 A1 * 3/2013 Lin ..... B32B 7/023 2/167
2015/0296902 A1 * 10/2015 Lin ..... A41D 19/0068 2/161.6
2017/0156809 A1 * 6/2017 Dennison ..... A41D 19/015
2019/0183193 A1 * 6/2019 Sorrels ..... B29C 66/73921
2019/0387819 A1 * 12/2019 Sperry ..... B65D 83/0805

OTHER PUBLICATIONS

"Coextrusion"; https://www.dictionary.com/browse/coextrusion; dictionary.com Unabridged Based on the Random House Unabridged Dictionary, © Random House, Inc. 2023 (Year: 2023).*

* cited by examiner

POLYMERIC GLOVES AND METHOD OF MANUFACTURE

FIELD

The present disclosure generally relates to disposable plastic gloves.

BACKGROUND

Disposable plastic gloves are used to protect hands and fingers from items or contaminants commonly found in medical settings, food preparation areas, laboratories, and so on.

SUMMARY

In one aspect of the present invention, a method of making a multilayer disposable glove from individual layers of film is disclosed. The method comprises providing at least three individual layers of film. Next, the method comprises arranging the at least three individual layers of film into a stack, the stack including a first stack portion that has at least two of the individual layers and a second stack portion that has at least one of the individual layers. Next, the method comprises sealing the first and second portions together along a hand-shaped outline. Finally, the method comprises cutting the sealed stack along the hand-shaped outline so the seal remains intact, thereby forming a multilayered glove.

In yet another aspect, a multilayer disposable glove formed from individual layers of film comprises at least three individual layers of film. A first stack portion comprising at least two layers and a second stack portion comprising at least one layer. The first stack portion and second stack portion are sealed together around a hand-shaped outline. The first and second stack portions are cut along the hand-shaped outline while the seal remains intact.

Other objects and features of the present disclosure will be in part apparent and in part pointed out herein.

BRIEF DESCRIPTION OF THE DRAWINGS

Corresponding reference numbers indicate corresponding parts throughout the drawings.

DETAILED DESCRIPTION

Figure 1:
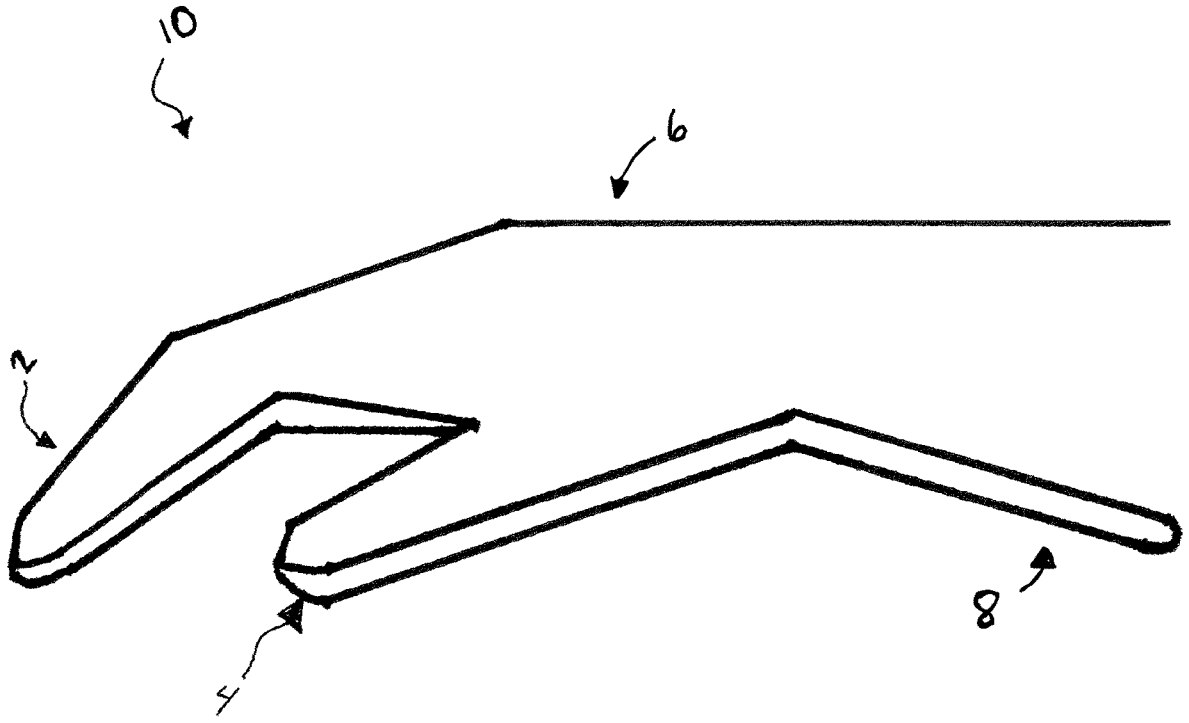
FIG. 1 is a schematic illustration of a side view of a multilayered glove.

Referring now to FIG. 1, a multilayer layer disposable glove is indicated generally by 10. A glove of this type may be useful for handling food items, or in situations where it is not desirable for a user's skin to come into contact with the item or material being handled. In many circumstances, it is desirable to have a glove including not one layer, but at least two layers, of polymeric material on a palm side of the glove, because this is where the glove will contact the item/material and be subject to the most wear and tear. Opposite the palm side, a back side of the glove can have at least one layer of polymeric material but may be of two or more layers, of material (FIG. 1). The back side of the glove is not as likely to be subject to considerable wear and tear. FIG. 1 shows the glove 10 schematically in longitudinal section. The glove 10 includes finger portions 2 (only one of which may be seen in FIG. 1) and a thumb portion 4. The finger portions 2 and thumb portion 4 are attached to a primary palm portion 6 of the glove 10. A wrist portion 8 of the glove extends from the palm portion 6 on a side opposite the finger and thumb portions 2, 4. As is conventional, the wrist portion 8 defines an opening through which the hand may be inserted for donning the glove. As may be seen, the glove 10 is formed with two layers of material on a lower, palm side of the glove and one layer of material on the upper, back of the hand side.

An example method of making the multilayer disposable glove will now be described. The method generally comprises the steps of providing at least three individual layers of material; arranging the at least three layers into a stack; sealing the arranged layers into the shape of a glove; and cutting around the seal so to form a glove that includes at least three layers. The layers could come from a single web of film or multiple webs. The material and characteristics of the webs of film may be the same or different.

Plastic material (e.g. polyethylene) is processed into a workable web, (broadly, "film"). The inventors have found this method can be performed using individual, distinct, layers of film—not coextruded layers of film. Thus, the glove 10 can be formed from one or more standard webs of film that are stacked, sealed and cut. As will be described further, there is not necessarily a 1:1 correlation between a layer and a film. Rather, a layer may be a function of the film. In the illustrated embodiments, a film may comprise a single layer, which is 1:1. In another embodiment, a film may be folded over onto itself to comprise a double layer, which is 1:2. In another embodiment still, a film may be folded over onto itself twice to comprise a triple layer, which is 1:3. (See FIGS. 9, 3, 6, respectively). One aspect of the present invention is that gloves are formed without any molding or forming, but rather from webs of film that can be conventionally produced.

Figure 2:
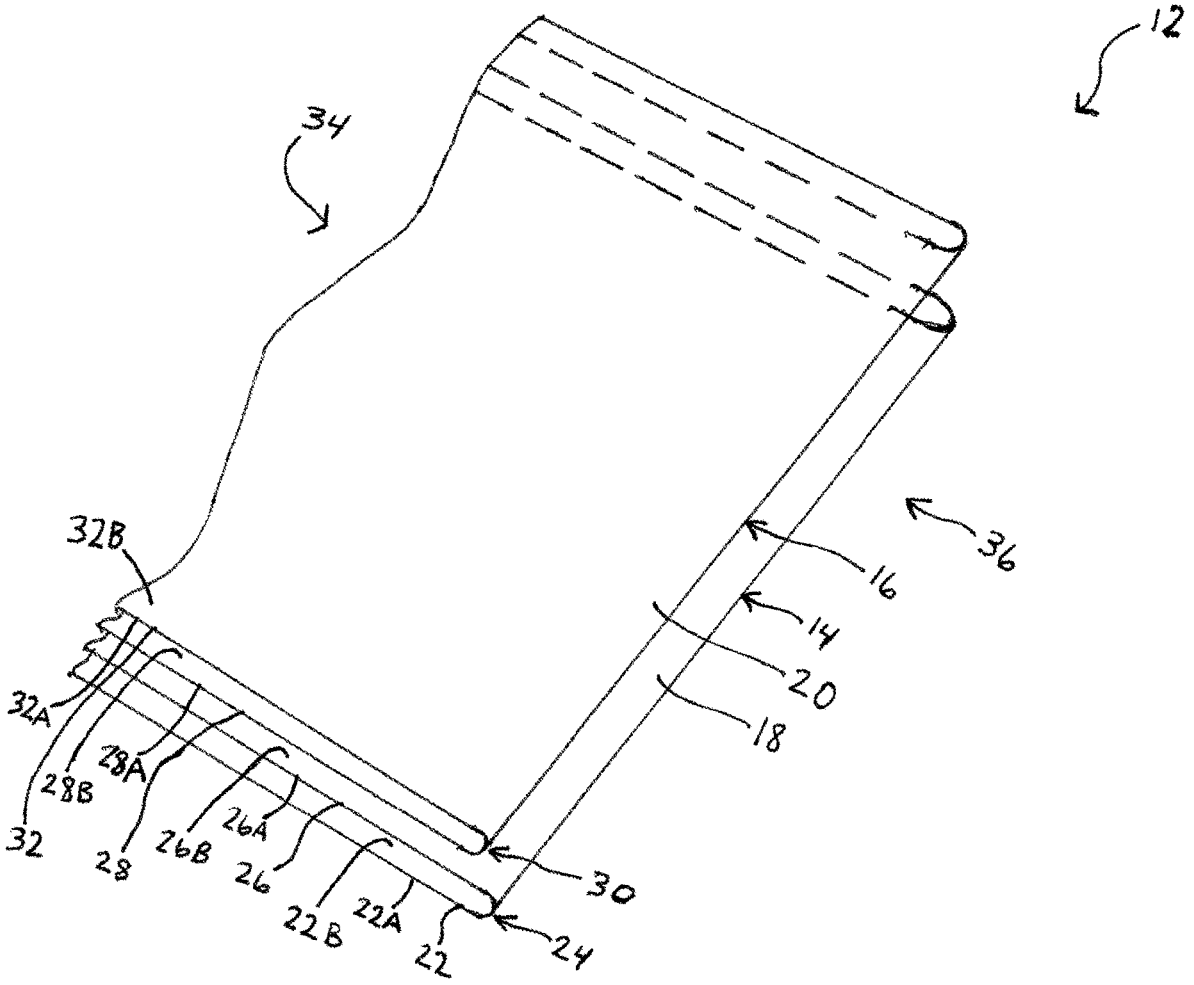
FIG. 2 is a schematic illustration of a top perspective view of a stack.
Figure 3:
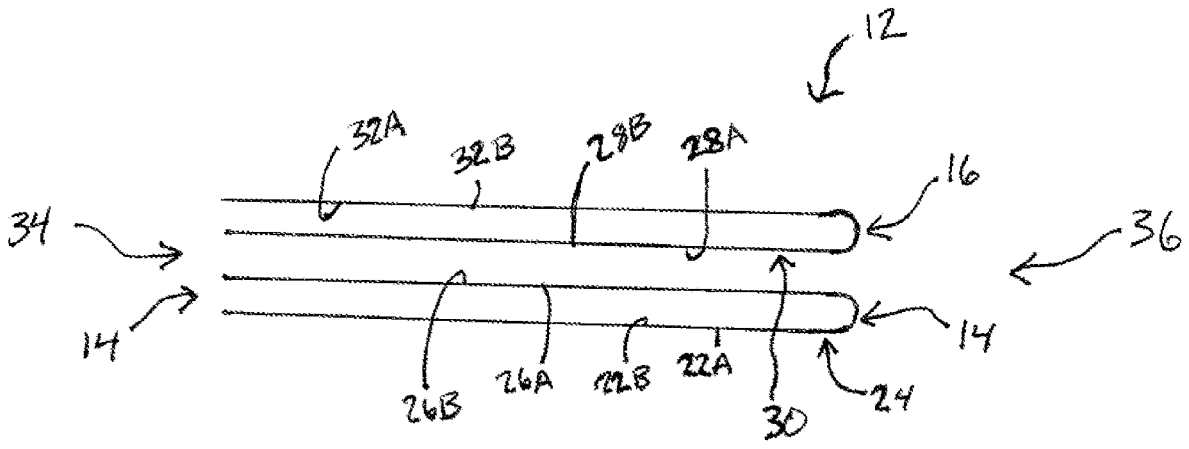
FIG. 3 is a schematic illustration of a side view of the stack in FIG. 2.

The first two steps of providing at least three layers and arranging said layers into a stack will be further described. FIGS. 2 and 3 show a stack of four individual layers generally indicated by reference number 12. The stack comprises a first stack portion 14 and a second stack portion 16. The first and second stack portions 14 and 16 are formed from a first and a second film 18 and 20, respectively. In the illustrated embodiment, the first and second films have the same thickness however, one film may have different material characteristic (e.g., thickness, color, density, etc.) or be of a different material than the other film. The first stack portion 14 includes a first layer 22 having a first face 22A, and an opposite second face 22B. The first film 18 is folded over onto itself one time at fold 24. The fold 24 allows the first film 18 to provide a second layer 26. No connection of the first layer 22 and the second layer 26 need to be made at the fold 24 to form the glove 10, as the layer extends continuously through the fold. Use of this feature in the formation of the glove 10 is explained more fully hereinafter. The second layer 26 has a first face 26A, and an opposite second face 26B. Similar to the first stack portion 14, the second stack portion 16 includes a third layer 28 having a first face 28A, and an opposite second face 28B. The second film 20 is folded over onto itself one time at fold 30. The fold 30 allows the second film 20 to provide a fourth layer 32. No connection of the third layer 28 and the fourth layer 32 needs to be made at the fold 30 to form the glove 10, as the layer extends continuously through the fold. Use of this feature in the formation of the glove 10 is explained more fully hereinafter. The fourth layer 32 has a first face 32A, and an opposite second face 32B.

In the illustrated embodiment, the edges of the layer 22 and the edges of the layer 26 of the first film 18 are aligned. Similarly, the edges of the layer 28 and the edges of the layer 32 of the second film 20 are aligned. Misalignment of the edges of the layers 22, 26, 28, 32 is possible, but for avoiding wrinkles in the layers and achieving efficient usage of material, alignment is preferable. The stack 12 is formed by placing the second stack portion 16 over the first stack portion 14 so that all edges are again substantially aligned. The edges of the layers 22, 26, 28, 32 which are unconnected are aligned over each other, and the folds 24, 30 are aligned over each other. Some offset of the stack portions 14, 16 (not shown in FIGS. 2 and 3) may be beneficial, as will be described hereinafter. It will be appreciated that although the drawings show separation between the layers 22, 26, 28, 32, and between the stack portions 14, 16, to facilitate the visual differentiation and description of the layers and stack portions, in practice all of the layers 22, 26, 28, 32 would substantially lie in direct engagement with the adjacent layer(s) in the stack 12.

Figure 4:
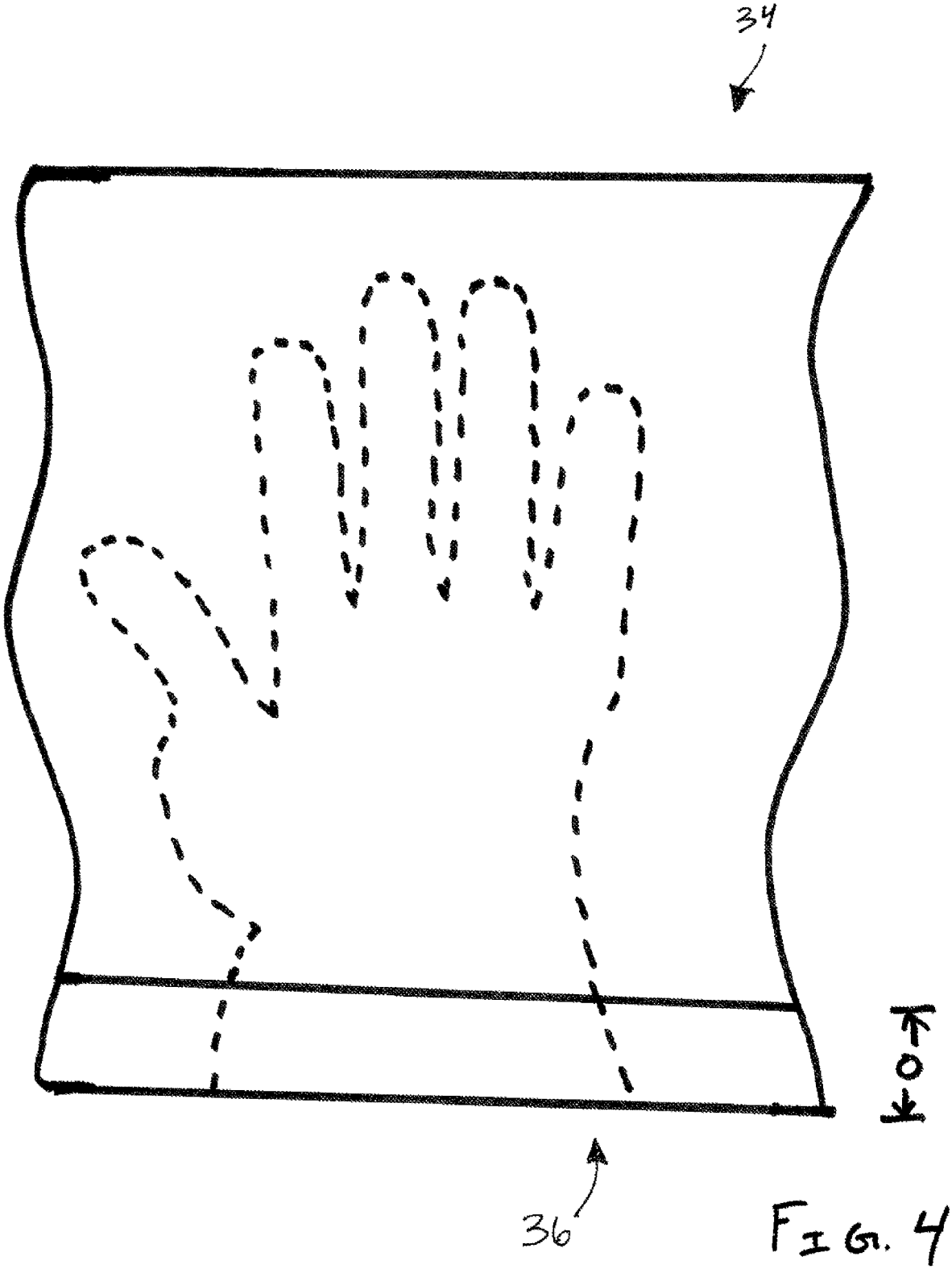
FIG. 4 is a schematic illustration of a top view of a stack relative to a hand-shaped outline.
Figure 5:
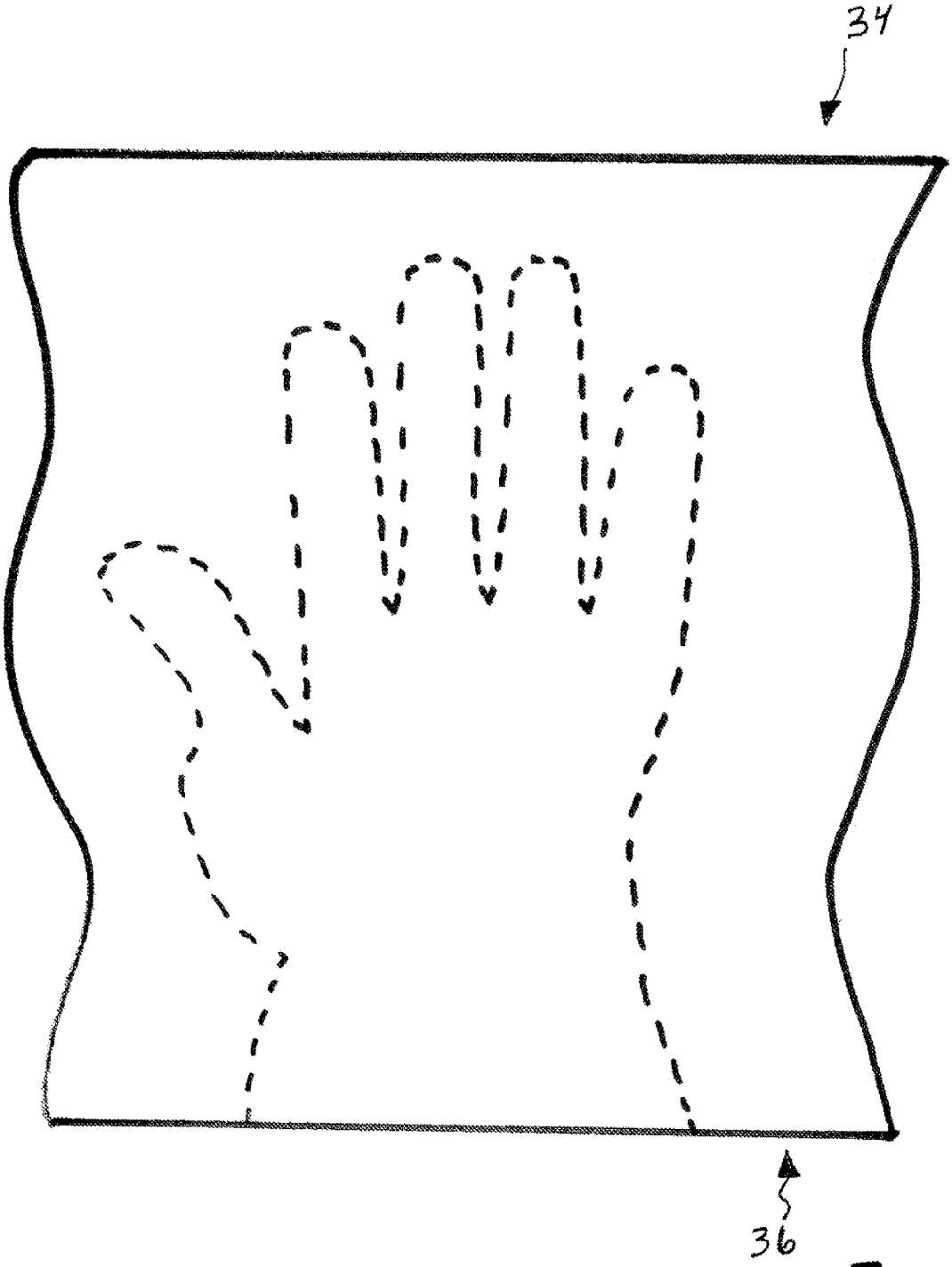
FIG. 5 is a schematic illustration of a top view similar to FIG. 4.

Referring to FIGS. 4 and 5, steps of sealing and cutting will be further described. The basic operation of sealing and cutting using a die press are described in greater detail in U.S. Patent Publication 2013/0067635, which is incorporated herein by reference in its entirety. All instances of sealing described herein may be carried out in any suitable manner, such as by fusing, adhering, etc. In the illustrated embodiment, sealing and cutting may be performed using the die press which has a wrist portion. It will be understood that the method is not limited to use of a die press, other such forming tools may be used for the sealing and cutting steps. FIGS. 4 and 5 schematically illustrate the stack as received in the die press. The operative portion of the die press is indicated by dashed lines in the figures, and no other portion of the die press is illustrated in the drawings. The operative portion is that portion of the die press which engages the stack 12 to cut and seal the layers 22, 26, 28, 32 to form a glove. The stack 12 is disposed in the die press so that the aligned folds 24, 30 are at the wrist end of the operative portion of the die press. The unconnected portions of the layers 22, 26, 28, 32 are disposed in the die press beyond, but proximate to the tips of the fingers of the operative portion of the dies press, and also along the sides of the operative portion of the die press. It will be understood that in some embodiments, the web of film 18 used to form the first stack portion 14 (FIG. 2), and the web of film 20 used to form the second stack portion 16 may be very long. Each web of film 18, 20 can be folded and run through one or more die presses for a continuous operation to form gloves. The unconnected edges of the layers 22, 26, 28, 32 opposite the folds 24, 30 may be said to be on a first side 34 of the stack 12, and the aligned folds may be said to be a second side 36 of the stack.

The sealing step generally comprises sealing along the operative portion of the dies press. It will be appreciated that all of the unconnected portions of the layers 22, 26, 28, 32 of the stack 12 are joined together in the sealing step along the operative portion of the dies press, leaving the layers unconnected in a hand-shaped region inside the boundary formed by the seal from the operative portion. The remaining unconnected hand-shaped region defines a volume (bounded by the seal) that can receive a human hand. The operative portion of the die press extends all the way to the second side 36 of the stack so that the formed glove can be separated from the stack 12. The operative portion of the die press does not extend along the second side 36. Therefore, the layers 22, 26, 28, 32 are not joined together along the second side 36 by the die press. However, because of the presence of the folds 24, 30, the layers 22 and 26 are already connected to each other, and the layers 28 and 32 are already connected to each other. Therefore, a single opening between the first stack portion 14 and the second stack portion 16 remains after the operative portion of the die press has sealed the other parts of the layers 22, 26, 28, 32 together. When a hand is inserted into this opening at the second side 36 and passes into the volume, the layers 22, 26 of the first stack portion 14 are located adjacent to the palm or front of the hand, and the layers 28, 32 of the second stack portion 16 are located adjacent to the back side of the hand. Immediately after sealing, or substantially simultaneously, the cutting step is performed so to cut around the periphery such that the seal remains intact, but the formed glove is separated from the webs of film 18, 20.

In the illustrated embodiments of FIGS. 2, 3 and 5, the folds 24, 30 are aligned with each other however, the folds 24, 30 may be generally offset (i.e., not aligned). For example, on offset margin "O" between the folds 24, 30 is shown in FIG. 4. One way of accomplishing the offset is to have one of the webs of film 18, 20 be wider than the other. Thus, when the webs of film 18, 20 are folded over onto themselves as previously described to form the first and second stack portions 14, 16 and the edges of the layers 22, 26, 28, 32 aligned on the first side 34, the folds 24, 30 on the second side 36 are offset by a distance O. The glove may otherwise be formed in the same manner. The offset makes it easier to separate the first and second stack portions 14, 16 to open the glove for inserting one's hand into the glove.

Other embodiments of the providing and arranging steps will now be described. After the providing and arranging steps, the sealing and cutting steps are performed as generally described above.

Figure 6:
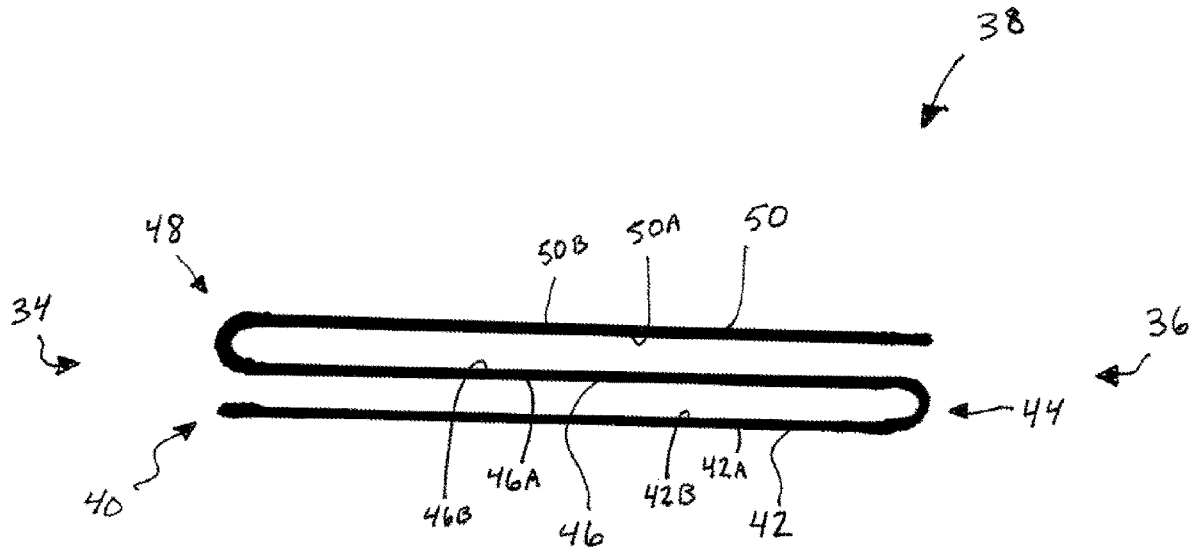
FIG. 6 is a schematic illustration of a side view of a stack.

Referring now to FIG. 6, a glove may be formed from a stack 38 that is created from a single web of film 40. The stack 38 is formed by folding the film 40 back on itself at a first fold 44, and then folding back on itself again at a second fold 48. As formed, the stack 38 has three layers. A first layer 42 includes a first face 42A, and an opposite second face 42B. A second layer 46 has a first face 46A, and an opposite second face 46B A third layer 50 has a first face 50A, and an opposite second face 50B. The fold 48 is aligned with the free edge of the layer 42 and the fold 44 is aligned with the free edge of layer 50. The layers 42 and 46 form a first stack portion in this embodiment, and the layer 50 forms a second stack portion. The edge margins and folds may not be aligned.

Next, the sealing and cutting steps are performed. The second side 36 of the stack 38 is arranged generally adjacent to the part of the operative portion of the die press forming the wrist end of the glove, and the first side 34 of the stack 38 is arranged generally adjacent to the tips of the fingers of the operative portion of the die press. During sealing, all of the layers 42, 46, 50 near the first side 34 are joined together.

The layers 42, 46, 50 near the second side 36 remain unconnected after the sealing step. However, because of the fold 44 connecting layers 42 and 46 at the second side 36, the only opening into the glove volume is between the second layer 46 and the third layer 50. In this embodiment, the glove 10 formed has two layers (42, 46) on the side adjacent to the palm and front of the hand and one layer (50) adjacent the back of the hand, for example as illustrated in FIG. 1.

Figure 7:
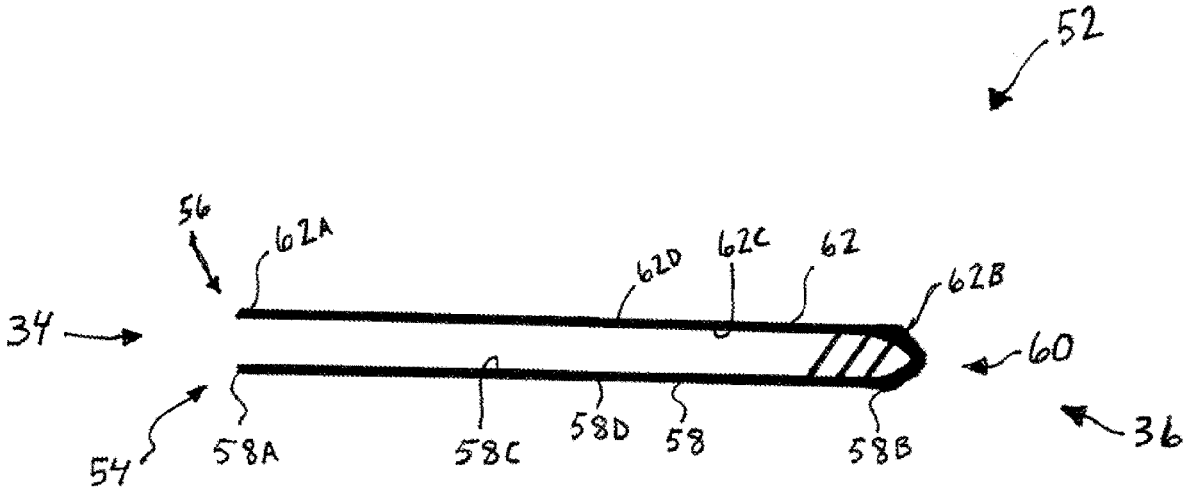
FIG. 7 is a schematic illustration of a side view of a stack portion.

In some cases, it is preferable that the layers of film on one side, and in particular the palm side of the glove not be the same material. For example, it is desirable to make it readily visually apparent that the palm side of the glove has been broken or punctured. One way to do this is to provide an opaque outer layer of one color, and an inner layer of another color. The inner layer is preferably a bright color (e.g., red) and the outer layer of a standard glove color such as white. Referring now to FIG. 7, a stack portion 52 comprises two individual layers formed from two individual films 54 and 56. The film 54 is white (or other suitable color), and the film 56 is red (or other suitable contrasting color). The film 54 defines a layer 58 having an inner face 58C and an outer face 58D, and the film 56 defines a layer 62 having an outer face 62D and an inner face 62C. In this embodiment, the first and second layers 58 and 62 are not arranged in a stack by way of a fold, but rather edge margins 58B and 62B simply overlie one another and are sealed together at a sealed connection 60 prior to formation of the glove in the die press. It will be understood that if the (white) layer 58 is punctured or torn, the (red) layer 62 will become visible through the layer 58. This alerts the user to put on a new glove. However, prior to any puncture or tear, the (red) layer 62 will be covered up and not visible. Opposite edge margins 58A and 62A of the layers 58, 62 remain unconnected and not sealed prior to formation of the glove. It is understood that the embodiment described requires at least one more layer (forming its own, second stack portion) added prior to sealing and cutting. For example, a single layer of a single film may be added, or a double layer that is folded over onto itself once; or two layers sealed at an edge margin. The at least three layers will be received in a die press for sealing and cutting as described previously. The unsealed side of the stack will be adjacent to the fingers of the die and the side with the sealed connection will be adjacent to the wrist portion of the die. The sealed connection 60 forms in-part, the edge margin of an opening into the glove. It is to be understood that instead of having different colors, the layers 58, 62 may be entirely the same or distinguished by some other characteristic other than color (e.g., thickness, material type or composition, etc.).

Figure 8:
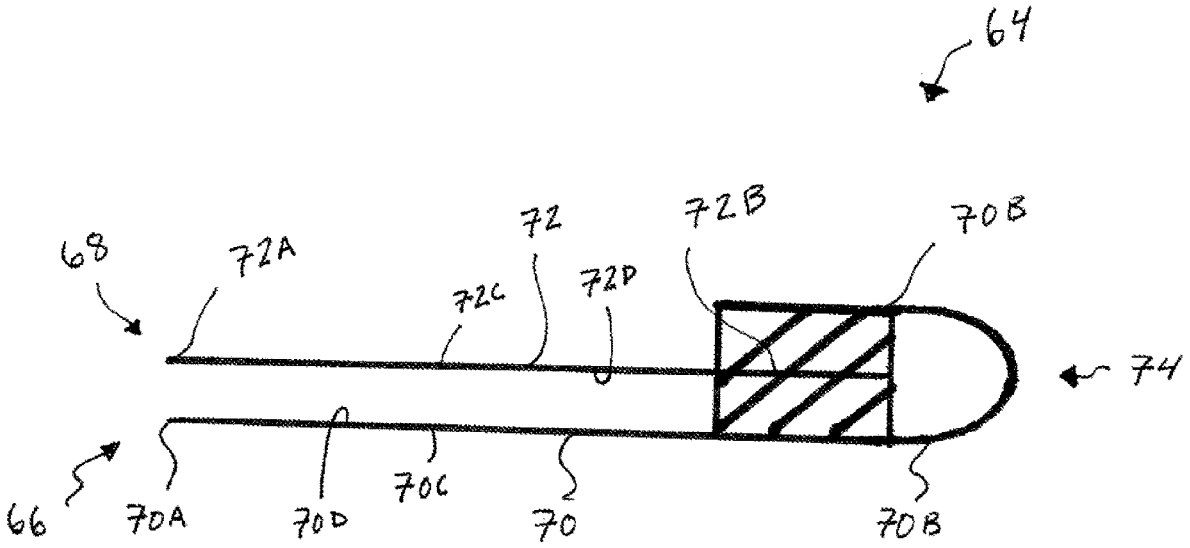
FIG. 8 is a schematic illustration of a side view of a stack portion.

Another non-limiting way of forming two layers similar to what was described for FIG. 7 is shown in FIG. 8. The stack portion 64 of FIG. 8 comprises two individual layers formed from two individual films 66 and 68. In this embodiment, the first layer 70 is wider than the second layer 72. An edge margin 70B of the first layer is folded around and joined to an outer face 72C of the second layer 72 on the opposite side of the second layer from the inner face 72C facing toward an inner surface 70D of the first layer 70. The joining of the edge margin 70B of the first layer 70 to the edge margin 72B of the second layer 72 forms a seal 74. The size of the seal 74 is greatly exaggerated in the drawing so that it can be readily seen. Of course, a similar construction could be achieved if the second layer 72 was wider than the first layer 70 and folded around an edge margin 70B of the first layer. Opposite edge margins 70A and 72A remain unconnected and not sealed prior to formation of the glove. It is understood that the embodiment described requires at least one more layer added prior to sealing or cutting. The at least three layers will be placed in a die press for sealing and cutting. The unsealed side of the stack will be adjacent to the fingers of the die and the side with the sealed connection will be adjacent to the wrist portion of the die.

Figure 9:
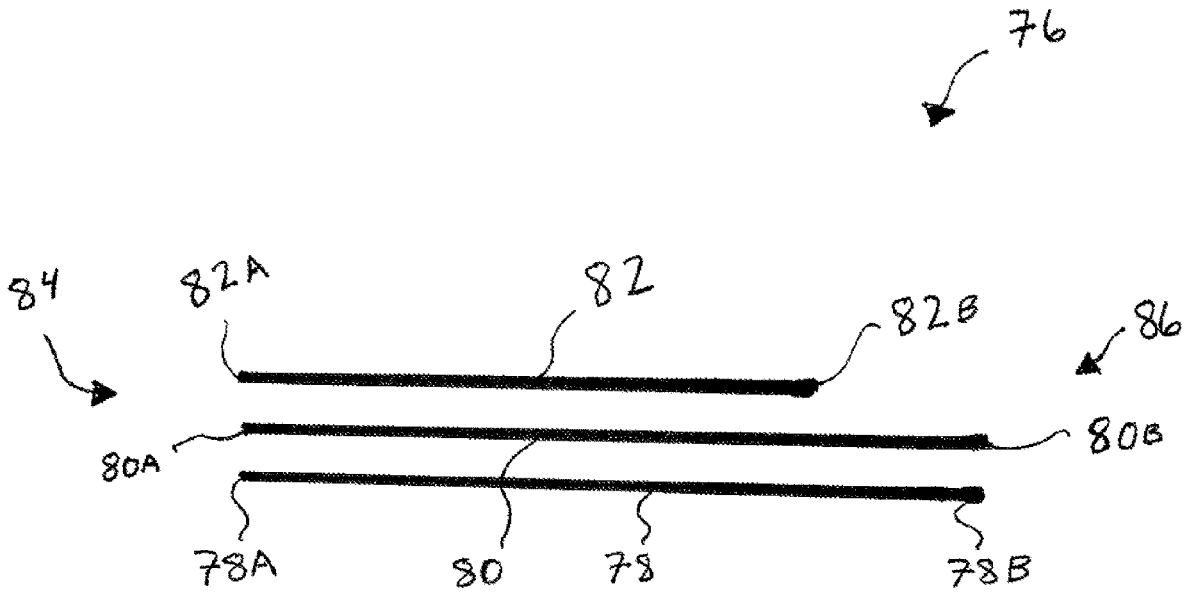
FIG. 9 is a schematic illustration of a side view of a stack.
Figure 10:
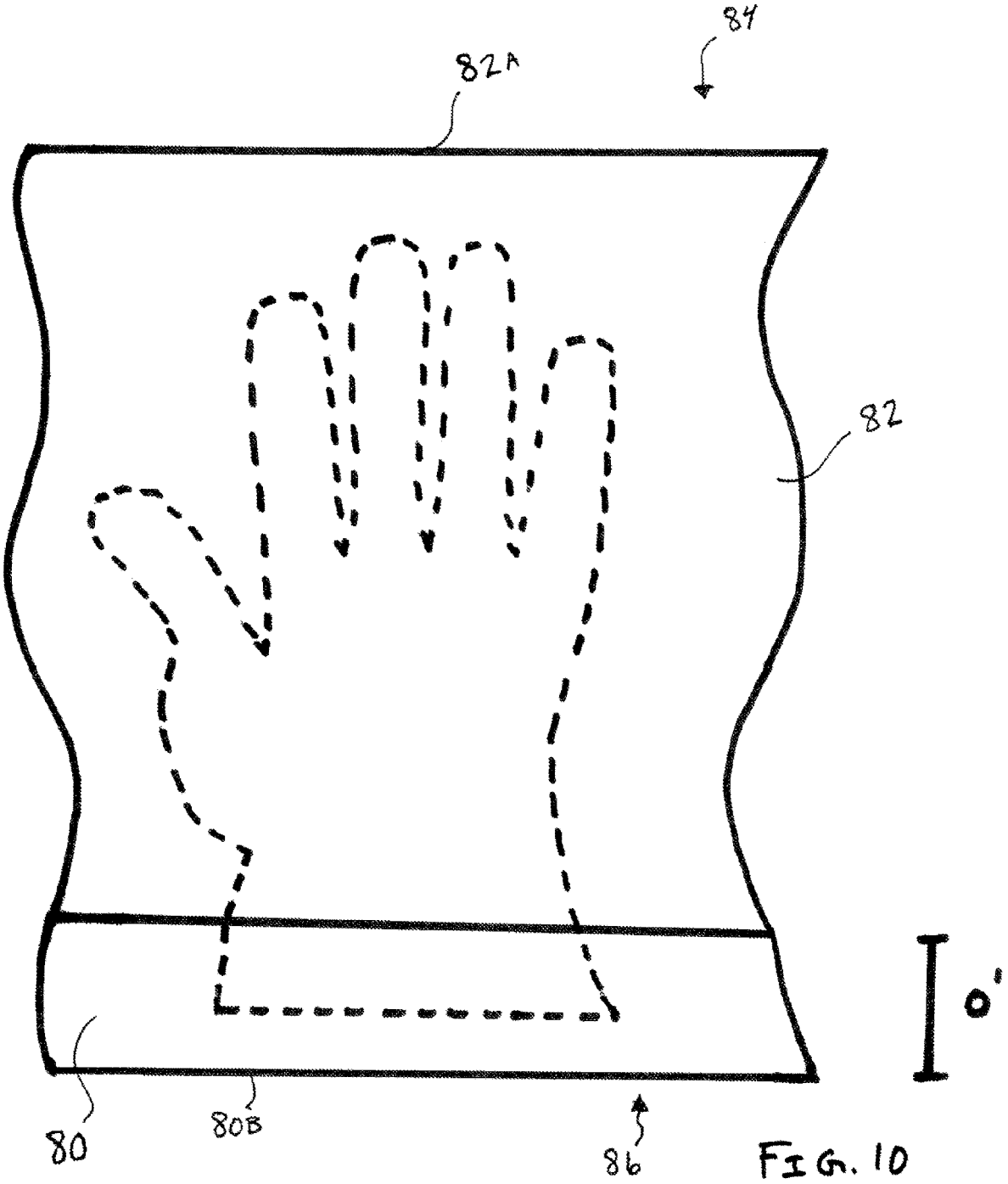
FIG. 10 is a schematic illustration of a top view similar to FIGS. 4 and 5.

Referring to FIGS. 9 and 10, a stack 76 comprises three individual layers 78, 80, and 82 formed from three individual webs. Edge margins 78A, 80A, and 82A, are aligned, and edge margin 82B is offset from aligned edge margins 78B, 80B by an amount O'. The layers 78 and 80 form a first stack portion in this embodiment, and layer 82 forms a second stack portion. The stack 76 is placed into the die press so that the aligned edge margins 78A, 80A and 82A on a first side 84 of the stack 76 are nearest the tips of the fingers of the operative portion of the die press, and the edge margins 78B, 80B and 82B on a second, opposite side 86 of the stack are nearest a wrist end of the operative portion of the die press. Unlike previous embodiments, there is no pre-existing connection between the two layers 78, 80 that will form the palmar portion of the glove. Accordingly, the operative portion of the die press (shown by dashed lines in FIG. 10), includes a transverse segment. The transverse segment both seals the layers 78, 80 together and separates the wrist portion 8 of the glove from the remainder of the stack 76. The transversely extending portion of the layer 82 is not sealed with or otherwise connected to the layers 78 or 80. Accordingly, there is an opening or mouth into the internal volume of the glove at the wrist portion 8 between layers 80 and 82. More specifically, there is only one opening into the glove on the second side 86 of the stack 76, because the layers 78, 80 are joined together along the transverse segment of the operative portion of the die press. After sealing and cutting, it will be appreciated that the offset edge margins (82B and 78B, 80B) of the stack 76 define the mouth of the glove. The offset at the glove mouth may ease pulling apart the edges of the glove, prior to donning.

As various changes could be made in the above products and methods without departing from the scope of the disclosure, it is intended that all matter contained in the above description shall be interpreted as illustrative and not in a limiting sense.

When introducing elements of the present disclosure or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the disclosure are achieved and other advantageous results attained.

What is claimed is:

1. A method of making a multilayer glove, the method comprising:

arranging a first stack portion including a first film and a second film and a second stack portion including a third film in a stack;

sealing the first and second stack portions together along a hand-shaped outline such that the first stack portion and the second stack portion form a hand-shaped space therebetween sized and shaped to receive a hand of a user, the first film and second film of the first stack portion being positioned on a palm side of the multilayer glove and the third film of the second stack portion being positioned on back-hand side of the multilayer glove; and cutting the sealed stack along the hand-shaped outline so the seal remains intact.

2. The method of claim 1, wherein the first film, second film, and third film are formed separately from one another such that the first film, second film, and third film are not joined to one another in the stack prior to said sealing.

3. The method of claim 1, wherein said arranging the first and second stack portions in the stack includes forming the first film and the second film from a single film.

4. The method of claim 3, wherein said forming the first film and the second film from the single film includes folding the single film over onto itself.

5. The method of claim 1, wherein said arranging the first and second stack portions in the stack includes forming the first, second, and third films from a single film folded over onto itself twice.

6. The method of claim 1, wherein, prior to said arranging the first and second stack portion in the stack, the first film and second film are connected together.

7. The method of claim 1, wherein said sealing results in the first, second, and third films of the first and second stack portions are joined near a first side of the stack.

8. The method of claim 7, wherein said sealing results in the first and second stack portions remaining unsealed along an opposite second side of the stack.

9. The method of claim 8, wherein a set of fingers of the multilayer glove are formed nearer to the first side of the stack.

10. The method of claim 1, wherein one of the first, second, or third films is thicker than at least one of the other films.

11. The method of claim 1, wherein the second stack portion includes a fourth film, the fourth film being positioned on the back-hand side of the multilayer glove.

12. The method of claim 1, wherein said cutting includes cutting the first, second, and third films in the stack into the shape of a glove with a die press.

13. The method of claim 1, wherein said sealing and said cutting are performed substantially simultaneously.

14. The method of claim 1, wherein the first film and second film of the first stack portion are different colors.

15. The method of claim 1, wherein an edge of the first stack portion and an edge of the second stack portion are offset from one another near a wrist portion of the multilayer glove.

16. The method of claim 1, wherein none of the first, second, and third films are coextruded with one of the other films.

17. A multilayer glove comprising:

a first stack portion including a first film and a second film; and a second stack portion including a third film;

the first stack portion and the second stack portion being sealed together around a hand-shaped outline, the first stack portion and the second stack portion bounding a hand-shaped space therebetween sized and shaped to receive a hand of a user, the first film and second film of the first stack portion being positioned on a palm side of the multilayer glove and the third film of the second stack portion being positioned on back-hand side of the multilayer glove.

18. The multilayer glove of claim 17, wherein the first stack portion includes a first edge margin and a second edge margin, and wherein the first film and second film of the first stack portion are disconnected at the first edge margin and joined together at the second edge margin.

19. The multilayer glove of claim 17, wherein the first film and second film of the first stack portion are different colors.

20. The multilayer glove of claim 17, wherein an edge margin of the first stack portion and an edge margin of the second stack portion are offset from one another near a wrist portion of the multilayer glove.

21. The multilayer glove of claim 17, wherein the first film and second film of the first stack portion are formed from a single film.

22. The multilayer glove of claim 21, wherein the single film is folded over onto itself at a fold to form the first film and second film.

23. The multilayer glove of claim 22, wherein the fold is disposed at a wrist end of the multilayer glove.

24. The multilayer glove of claim 23, wherein the fold bounds an opening to the hand shaped space through which a user inserts a hand to put on the multilayer glove.

25. The multilayer glove of claim 21, wherein the single film includes multiple coextruded layers, the multiple coextruded layers forming both the first film and the second film.

26. The multilayer glove of claim 17, wherein the second stack portion includes a fourth film, the fourth film being positioned on the back-hand side of the multilayer glove.

27. The method of claim 4, wherein said folding the single film forms a fold in the first stack portion, and wherein said arranging the first and second stack portions in the stack includes arranging the first stack portion in the stack such that the fold of the first stack portion is disposed at a wrist end of the multilayer glove.

28. The method of claim 27, wherein said sealing and said cutting result in the fold of the first stack portion being in the formed multilayer glove.

29. The method of claim 27, wherein the hand-shaped outline along which the first and second stack portions has a first endpoint at a first location on the fold of the first stack portion and a second endpoint at a second location on the fold of the first stack portion, the second location being spaced apart from the first location.

30. The method of claim 3, wherein the single film forming the first and second layers of film of the first stack portion includes multiple coextruded layers.

31. The method of claim 30, wherein said forming the first film and the second film from the single film includes folding the single film over onto itself such that the order of the multiple coextruded layers in the first film is inverted relative to the order of the multiple coextruded layers in the second film when the first stack portion is arranged in the stack.

* * * * *